United States Patent [19]

Rothauser et al.

[11] 3,975,833

[45] Aug. 24, 1976

[54] DRIER

[75] Inventors: Charles Rothauser; Bruce R. Thompson, both of Norwood, Australia

[73] Assignee: United Packages Limited, Brisbane, Australia

[22] Filed: Mar. 12, 1975

[21] Appl. No.: 557,576

[30] Foreign Application Priority Data

Mar. 18, 1974 Australia ..... 6937/74

[52] U.S. Cl. ..... 34/151; 34/163; 34/239

[51] Int. Cl.[2] ..... F26B 13/00

[58] Field of Search ..... 34/90, 91, 151, 163, 34/239, 240, 232, 233, 234; 220/335, 336; 219/366–371; 312/236

[56] References Cited

UNITED STATES PATENTS

| | | | |
|---|---|---|---|
| 1,499,903 | 7/1924 | Beck | 34/233 |
| 1,867,388 | 7/1932 | Snively | 34/234 |
| 3,054,194 | 9/1962 | Hayes | 34/168 |
| 3,256,617 | 6/1966 | Konstandt | 34/163 |
| 3,513,567 | 5/1970 | Paul | 34/233 |

FOREIGN PATENTS OR APPLICATIONS

| | | | |
|---|---|---|---|
| 1,260,057 | 3/1961 | France | 34/151 |

*Primary Examiner*—Kenneth W. Sprague
*Assistant Examiner*—James C. Yeung
*Attorney, Agent, or Firm*—Oldham & Oldham Co.

[57] ABSTRACT

A clothes airer or drier that is fitted to a wall and can be collapsed to a compact shape. The upper end of the drier is designed as a compartment with a recess to receive portable heater-fan unit, the front of the unit having a hood movable from a closed position to an erected position where it is supported by a grid hinged to the main frame of the drier. The hood can be opened further to allow clothes to be placed on the grid.

4 Claims, 5 Drawing Figures

DRIER

This invention relates to a drier of the general type which can be wall mounted and which is collapsible so that it can be used in flats or the like where space is at a premium.

BACKGROUND OF THE INVENTION

With driers of the type outlined above it has been customary to provide a unit which included both a circulatory fan and a heater and to so mount the unit that it can be disposed against a wall where it can be attached, but so arranged that the unit can be swung out to co-act with guards or the like to spread the heated air over a support for the clothes or other articles, it being known also to utilise a removable air circulatory and heater unit so that this could be independently used as a room heater or cooler.

The type of construction generally used in these driers has made them somewhat bulky and in some cases unsightly, it being one of the objects of the present invention to provide a construction which will be readily mounted in position, which will at the same time allow effective folding of the various members which make up the unit, and which will be readily attachable to a wall or other support to take a minimum of space when not in use but will have considerable capacity for drying and similar purposes when in its extended position.

Various objects of the invention will be apparent from the following description of the invention which will be made in some detail, but it is to be clear that the invention need not necessarily be limited to such details.

SUMMARY OF INVENTION

According to the present invention the drier comprises a main frame which is adapted to be mounted on a wall or similar support, and on this frame are means whereby the air circulatory and heater unit can be supported and also a hood and a support grid so hinged to the main frame that in one position the hood and grid are folded to present only a small unit on the wall, but in the operative position the grid is extended and the hood is arranged to serve as air-diverting means to ensure correct flow through the clothes or the like being dried on the grid. Preferably a curtain member may also be included which when the drier is in use can extend downwardly from the grid to surround clothes or the like supported by the grid on the two sides and the front to ensure that air flow over the clothes which can hand from the grid will be correctly effected.

DESCRIPTION OF THE PREFERRED EMBODIMENT

Figure 1:
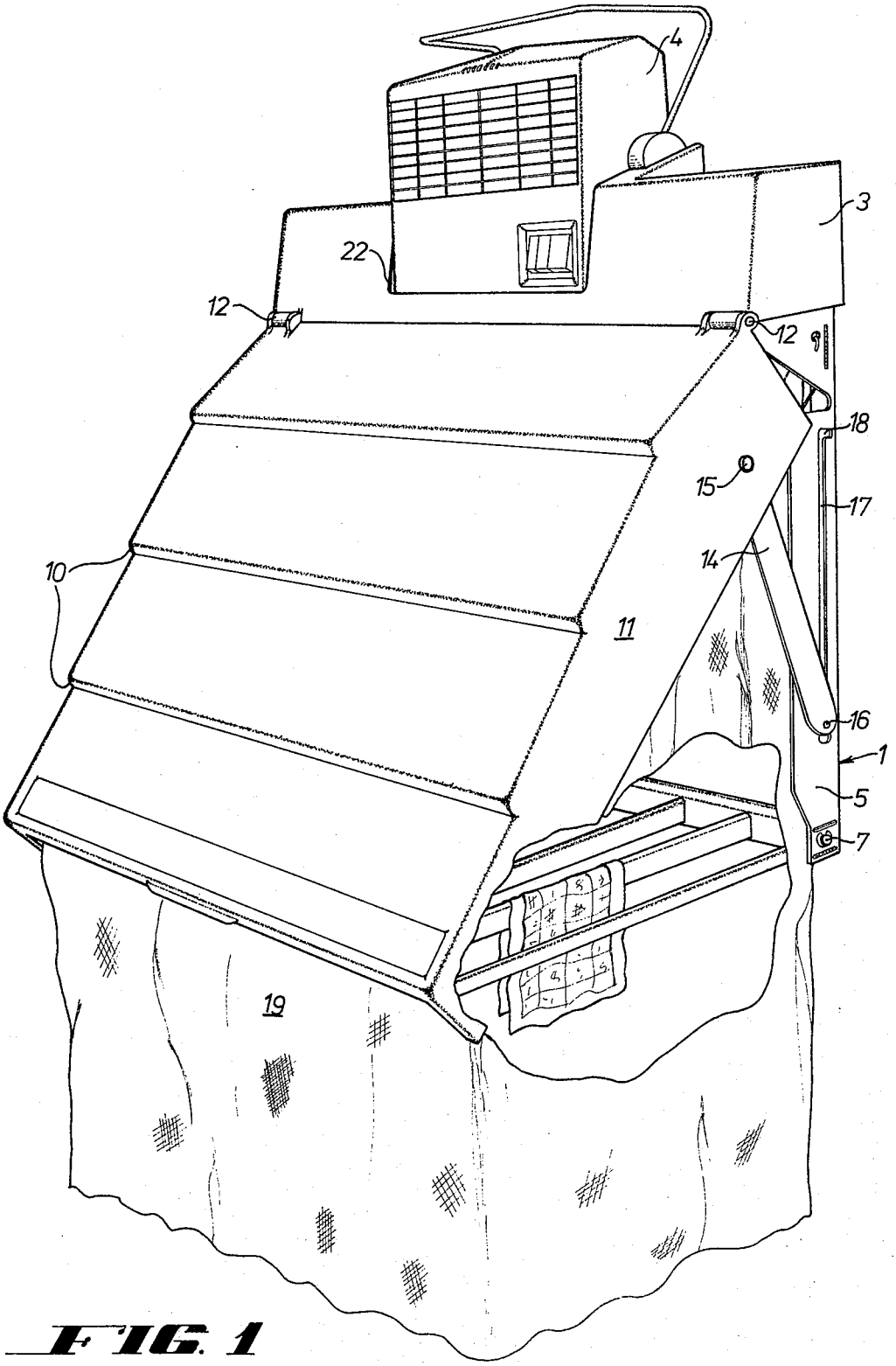
FIG. 1 is a general view of the invention, with portions broken away for clarity purposes.

According to a preferred form, the main frame 1 comprises a member which can be attached to a wall and consists of a back 2 with an outwardly extending section 3 at the top which forms a rest for the activating unit 4, namely the unit which contains air circulatory means such as a drum fan or the like and heater means whereby the temperature of the air can be controlled.

The air supply and heater unit 4 can conveniently be one of the readily available personal units which can be carried around but can be used in this case by fitting it into a recess at the top of the main frame so that the air flow is directed downwardly along the plane of the wall.

The main frame 1 has two side members 5 which extend outwardly a sufficient distance to carry the hinge means for the support grid 6 this grid being hinged by hinge pins 7 at its rear edge to the side members 5, the grid 6 being so arranged and so proportioned in relation to the main frame that it can be swung upwardly to lie against the frame to be co-planar with the wall to which the unit is attached, but can swing down to a position where it is approximately at right angles to the wall, the grid being supported in this operative position by cords 8 or the like between the frame 1 and the outer edge of the grid 6.

Hinged to the upper part of the main frame 1 on the outwardly extending portion 3 which in effect is a downwardly opening rectangular chamber, some distance out from the plane of the wall, is a hood 9 which has a front surface of stepped shape 10 both for attainment of rigidity but principally for air direction, this front surface having two side wings 11 of a dimension such that when the hood is swung about its hinges 12 into cover the grid 6 when the grid 6 is in its folded position by being swung upwardly to lie against the back 2 the front surface of the hood 9 together with the wings 11 forms an encasing member for the grid and for the main frame and also for curtains 13 or the like which can be supported by the grid 6.

The steps 10 thus form on the inside surface of the hood 9 directing surfaces so that the air flowing down the surface of the hood 9 is deflected downwardly to flow over the clothes hanging on the grid by the steps and the inclined surfaces between the steps.

Figure 2:
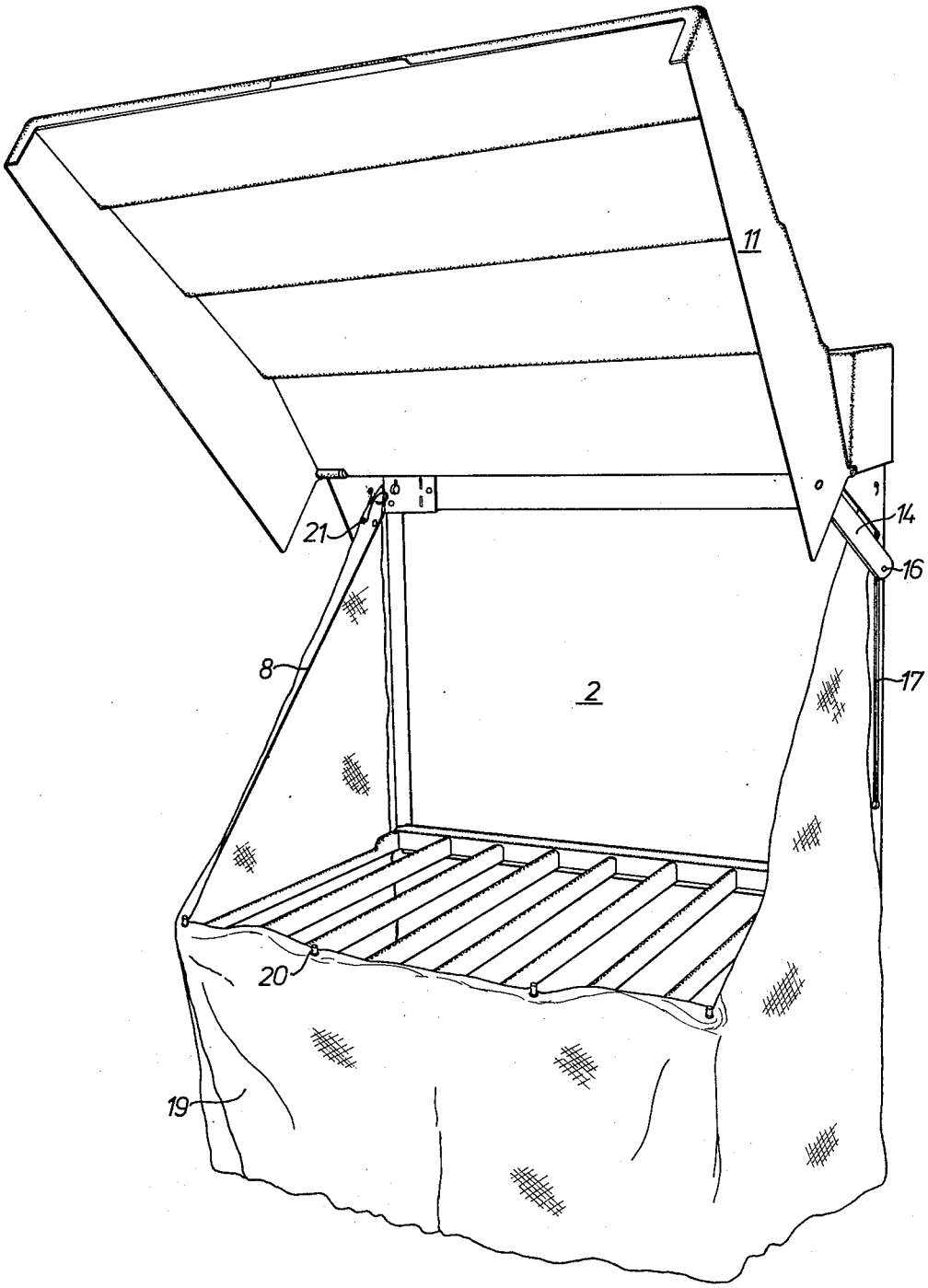
FIG. 2 is a view with the hood raised to show the support grid.
Figure 3:
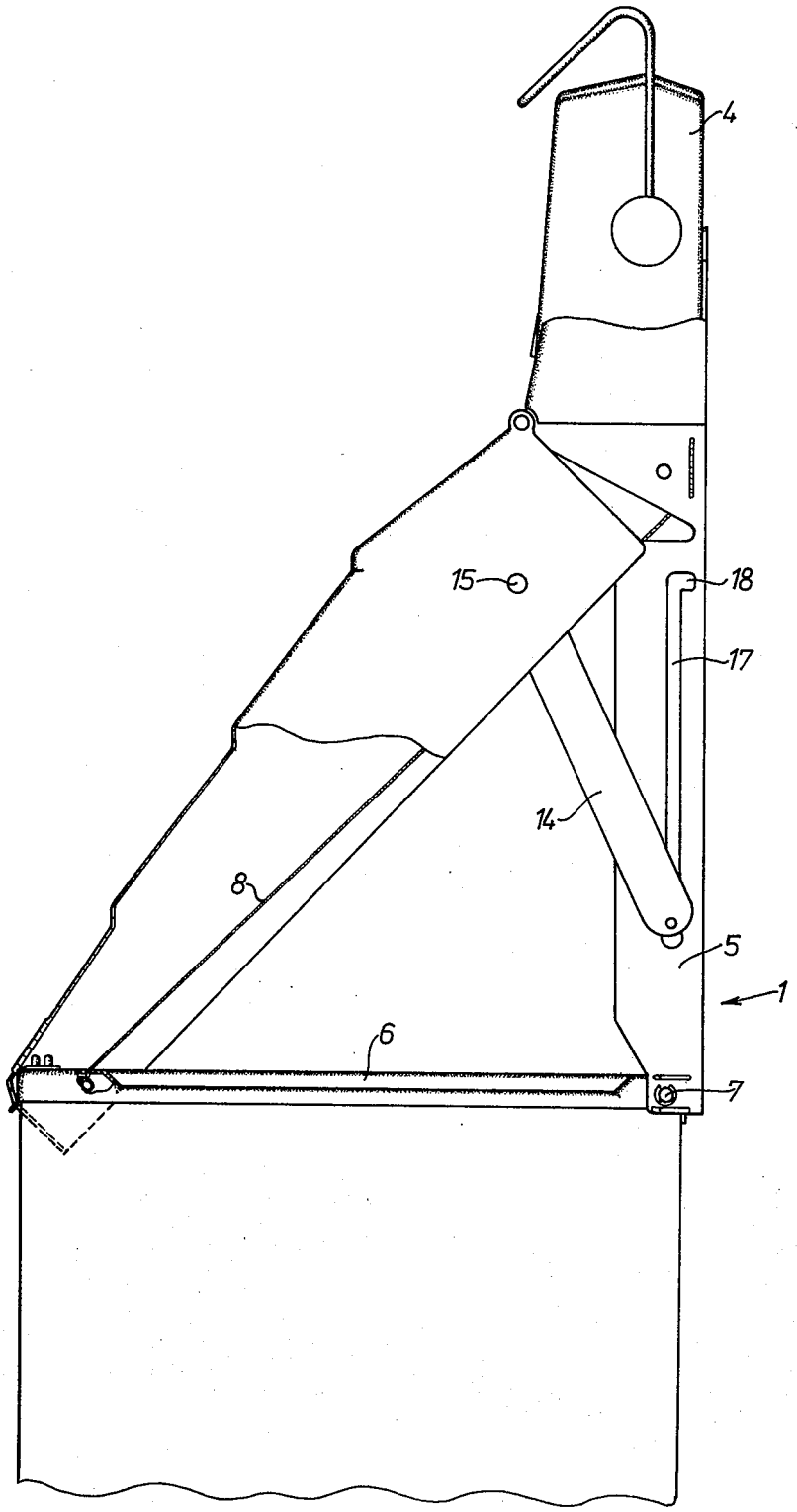
FIG. 3 is a side view, portions being broken away for clarity.
Figure 4:
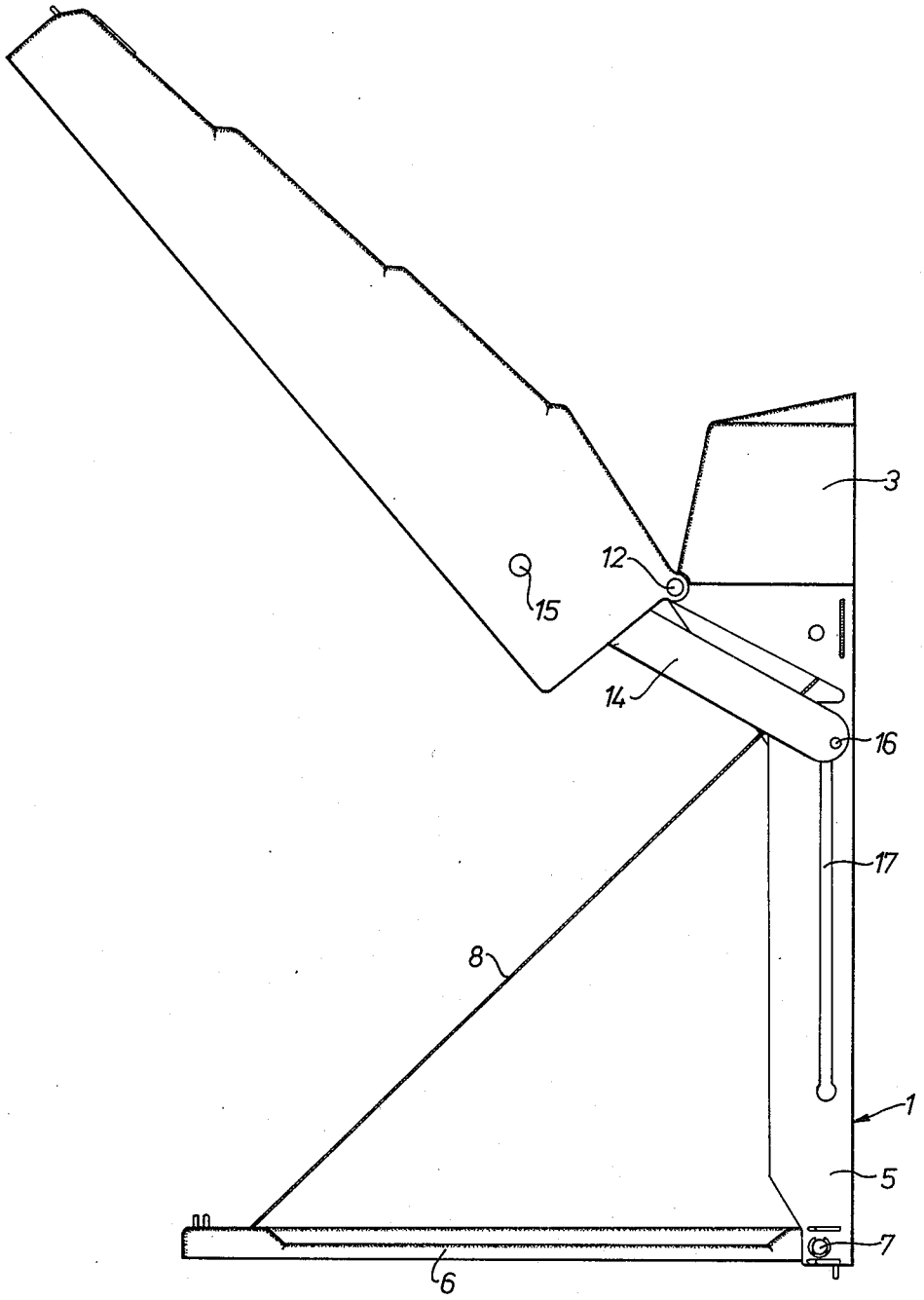
FIG. 4 is a side view similar to FIG. 3 but with the hood raised and the curtain and air circulating and heater unit removed.

To control the position of the hood 9, arms 14 are hinged by pins 15 to the upper rear portions of the side wings 12 of this hood and extend downwardly along the side member 5 of the main frame 1, a pin 16 on the free end of each of these arms 14 projecting into a slot 17 in the side members 5 which are so shaped that the hood can extend downwardly and then covers the hood control arms, but when the hood is moved upwardly to a position where its free end projects outwardly and/or upwardly, the pins 16 can engage in notches 18 in the slots 17 to hold the hood 9 in position as shown in FIGS. 2 and 4, the plane of hinging of the hood being of course offset from the plane in which the arms are hinged to the side wings of the hood to allow effective holding of the hood in a raised position.

When the hood is raised in this way, it exposes the grid and the grid which normally lies against the main frame, can be swung down as shown in FIGS. 2 and 4 until it reaches a relatively horizontal position, where it will be held by the cords 8 or the like, and clothes can now be placed onto the support grid, preferably by passing the clothes over the bars of the grid so that each article folds one of the grid members and then hangs downwardly below the grid.

The grid can readily be loaded when it is extended and the hood is in its upper position, and when the grid is loaded, or previous thereto, a curtain 19 can be attached to the grid 6 preferably by having suitable attaching pins 20 across the front of the grid and clips 21 at the corners thereof to hook to the upper portion of the side members 5, so that it extends along each side between the hood and the side members 5 and across the front of the grid 6 to form with the wall on which the unit is mounted a chamber which depends from the grid 6 and forms guide means for the air which is passing through the grid 6.

As the grid 6 is of considerable size as compared to the outlet area of the unit 4 which supplies the heated air, the hood together with the side wings 11 of the hood and the side members 5 of the main frame form an expansion chamber when the hood is swung down to have its outer free end engage and rest on the outer edge of the grid to support the hood. This then forms as it were a guide which ensures that the air flows over the whole of the support grid and out through the grid.

It will be realised of course that after loading, the hood is released from its raised position by releasing the hood control arms, and it is allowed to swing down to rest against the grid.

Figure 5:
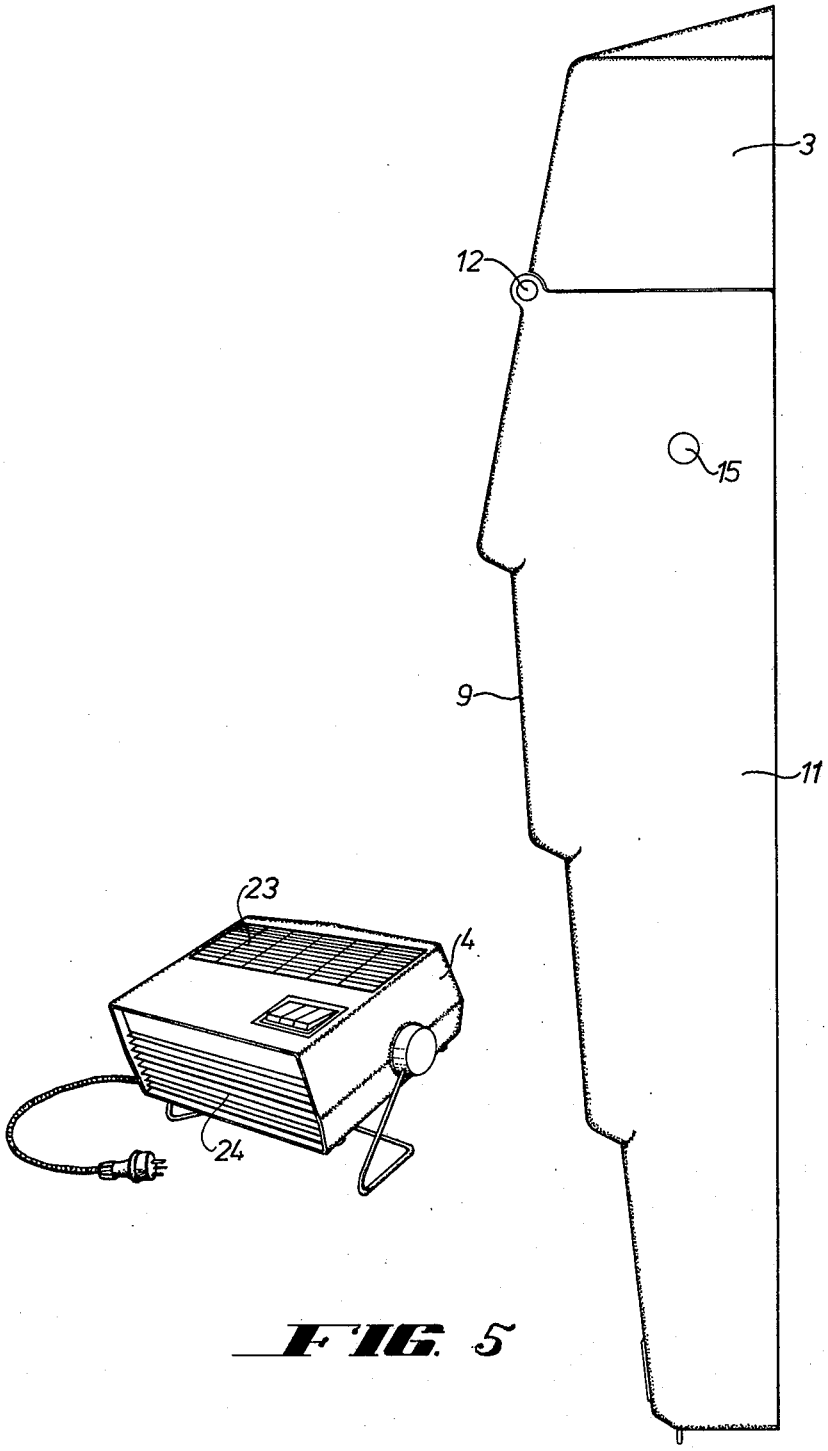
FIG. 5 is a side view of the hood folded and the air circulating and heater unit removed.

When the necessary drying of the clothes or the like has been effected, it will be realised that the hood can be readily raised to its locked upper position, thus exposing the articles which are supported by the grid 6, and the articles can then be removed, the curtain 19 either removed from the grid or folded up onto the grid, after which the grid can be swung upwardly about its hinge 7 until it lies within the main frame 1 and the hood can then again be released and allowed to move down its hinge but in this case instead of it terminating in an angular position which it assumes when the grid is extended, it folds right in to be parallel with the wall and a very neat unit then results with minimal projection into the room as shown in FIG. 5.

As stated earlier the air supply and heating unit 4 can be a personal or portable fan type of unit and if it is required for other purposes it can then simply be removed from the recess 22 in which it seats when forming part of the drier and can be used at any remote locality. The unit 4 has an air inlet 23 and an outlet 24 for the heated air.

The part at the top of the main frame which receives this unit is preferably shaped to have a socket or recess 22 into which the discharge portion at least of the unit

4 can neatly fit, and this upper part of the main frame can be in the nature of a chamber to direct the air flow from the supply and heating unit into the area defined between the wall and the front surface of the hood when this is in its operative position.

It will be realised that considerable variation in the constructional features of the invention can be achieved, but the basic feature of the unit is the foldability and the use of a rigid hinged hood which forms a cover for the other components of the unit such as a grid when not in use but which also forms a director for the air when it is in use to ensure correct drying of clothes or the like supported by the grid.

We claim:

1. A clothes airer or dryer comprising a main frame adapted to be mounted on a wall or similar support, a hollow upper section on the main frame and open downwardly when operatively positioned, said upper section on its upper portion having an aperture to detachably and operably engage and support a room heater fan unit, a hood pivotally secured at one end to said frame at the upper end thereof, and a grid pivoted to the lower end of the frame so that the grid can be folded up against the main frame, and the hood swung downwardly to cover the grid to provide a compact grid enclosed storage position, flexible means connecting the outer end of the grid to the upper portion of the frame to support the grid in a horizontal position, latch means to hold the hood in a raised position to allow clothes to be positioned on the grid, with the grid supporting the other end of the hood when the hood is lowered onto the outer end of the grid, the hood sloping downwardly from the frame to the outer end of the grid to form an air distribution chamber over the grid in the drying position.

2. A clothes airer or drier as defined in claim 1 wherein the hood is supported in its latched upper position by arms pivoted to the hood and slidable at their other ends in slots in side members on the main frame, notches being provided in the slots to retain the arms in the latched position.

3. A clothes airer or drier as defined in claim 1 wherein a curtain is provided to depend from the grid and frame to enclose the space holding the clothes on the grid.

4. A clothes airer or drier as defined in claim 1 wherein the upper section of the main frame is formed as a housing having a opening into which the heater fan unit can be fitted, the heater fan being portable to be used as a room heater when removed from the housing.

* * * * *